US006736191B1

(12) United States Patent
Lindberg et al.

(10) Patent No.: US 6,736,191 B1
(45) Date of Patent: May 18, 2004

(54) HEAT EXCHANGER HAVING LONGITUDINAL STRUCTURE AND MOUNTING FOR PLACEMENT IN SEAWATER UNDER PIERS FOR HEATING AND COOLING OF BUILDINGS

(75) Inventors: Ken Lindberg, Alamo, CA (US); Robert Longwell, Palo Alto, CA (US); David Mik, Danville, CA (US); Danny Reynolds, Alameda, CA (US)

(73) Assignee: Power Engineering Contractors, Inc., Alameda, CA (US)

( * ) Notice: Subject to any disclaimer, the term of this patent is extended or adjusted under 35 U.S.C. 154(b) by 0 days.

(21) Appl. No.: 10/135,899

(22) Filed: Apr. 29, 2002

Related U.S. Application Data

(60) Provisional application No. 60/328,303, filed on Oct. 9, 2001.

(51) Int. Cl.[7] ..... F28D 21/00

(52) U.S. Cl. ..... 165/45; 165/162; 62/260; 166/302; 166/57

(58) Field of Search ..... 165/45, 162; 62/260; 166/57, 302

(56) References Cited

U.S. PATENT DOCUMENTS 2,508,247 A * 5/1950 Giauque ..... 165/163
3,850,235 A * 11/1974 Beckmann et al. ..... 165/162
4,030,540 A * 6/1977 Roma ..... 165/172
4,154,295 A * 5/1979 Kissinger ..... 165/162
4,167,211 A * 9/1979 Haller ..... 165/163
4,272,667 A * 6/1981 Golowacz ..... 165/163
5,054,541 A * 10/1991 Tripp ..... 165/45
5,109,920 A * 5/1992 Merryfull ..... 165/163

* cited by examiner

*Primary Examiner*—Terrell McKinnon
(74) *Attorney, Agent, or Firm*—John W. Carpenter; Reed Smith LLP

(57) ABSTRACT

A heat exchanger having a set of heat exchanging coils supported in a horizontal direction. The coils operate to exchange heat in fluids provided to the coils from a source device via a supply header tube and returned to the source device (or provided to a second device) via a return tube. A backbone supports the heat exchanging coils. Preferably, the backbone runs inside the heat exchanging coils. A bracket attached to the backbone secures a set of exchange tube supports to which the exchanging coils are attached. The heat exchanger provides a strong structure that is able to withstand currents and tidal action when mounted under a pier or in other aquatic environments. An adjustable riser device provides for flexible installation.

51 Claims, 14 Drawing Sheets

(Note: Coils and supports are not shown for clarity)

HEAT EXCHANGER HAVING LONGITUDINAL STRUCTURE AND MOUNTING FOR PLACEMENT IN SEAWATER UNDER PIERS FOR HEATING AND COOLING OF BUILDINGS

CROSS REFERENCE TO RELATED APPLICATIONS AND CLAIM OF PRIORITY

This invention claims priority to the following co-pending U.S. provisional patent application, which is incorporated herein by reference, in its entirety:

Longwell et al., Provisional Application Serial No. 60/328,303, filed Oct. 9, 2001, entitled "Heat Exchanger Having Longitudinal Structure and Mounting For Placement Under Historic Piers".

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to heat exchangers, and in particular to a heat exchanger suitable for cooling of hot fluids in the vicinity of a water source for carrying away the exchanged heat. Even more specifically, the present invention provides a heat exchanger configuration, structure, and mounting system that can be used in conjunction with industrial, office, retail, residential or other spaces in or near waterfronts where cooling towers or other outdoor heat exchangers are not acceptable or unpermitted.

2. Discussion of Background

Heat exchangers are generally known for devices such as industrial cooling for hot fluids, air conditioning systems, and other uses. Heat exchangers vary in size and configuration from heat sinks used in electronic devices, to automotive radiators, to large cooling towers typically installed on or near office buildings or industrial rooftops.

Heat sinks for electronic devices generally take the form of a number of raised surfaces such as fins. A fan may be mounted on or near the fins to increase circulation that carries away the heat. Automotive radiators typically employ a serpentine tube having cooling fins attached.

Cooling towers for air conditioning and other systems generally employ either a serpentine or vertically coiled set of tubes and a fan for forcing circulating air over the tubes to exchange and carry away the heat. For example, each of U.S. Pat. No. 3,820,353, Shirashi et al, U.S. Pat. No. 3,782,451, Cates, and U.S. Pat. No. 4,964,977, Komiya et al, show one or more arrangements of known cooling towers.

These cooling towers, while generally efficient, do have a variety of operating costs, including costs for maintaining a circulation flow of the hot fluid through the heat exchange tubing. A fan is also generally required to maintain air flow, also increased electricity costs of operating the cooling tower.

Other types of heat exchangers for specific industrial purposes are also known. For example, U.S. Pat. No. 735,449 teach a jacketed heat exchangers to affect temperature on hydrocarbons recovered from a well. U.S. Pat. No. 2,193,309 teaches a heat exchanger system for warming high pressure gas wells, so as to the prevent formation of snow, ice particles or frozen articles.

Heat exchangers incorporating an array of tubes to form a bundle configuration is taught to some extent in U.S. Pat. No. 1,913,573 for a Radiator.

The marine environment is a harsh setting for deployment of mechanical or other systems, but provides a pool of liquid that may be utilized to exchange heat in a variety of situations. For example, U.S. Pat. No. 4,040,476 for a "Keel Cooler with Spiral Fluted Tubes", which system is submerged in a marine environment to cool the fluid therein. See also U.S. Pat. No. 4,043,289 which contemplates a keel cooler including a tube bundle. U.S. Pat. No. 5,573,060 is another example of heat exchangers directly employed in seawater.

Waterfronts across the U.S. and worldwide are currently undergoing large amounts of revitalization and other development. Generally, revitalization and/or development of waterfronts are normally restricted by stringent building codes that either limit a maximum height of building and any attachments placed on rooftops. In restoration areas, original rooflines are often required to be maintained. These restrictions make it difficult to employ convention cooling towers or other systems for air conditioning and other uses.

SUMMARY OF THE INVENTION

The present inventors have realized the need for an efficient heat exchanger for use in office building air conditioning and other uses. The inventors have also realized the need for a heat exchanger that can be deployed without altering an original facade, roofline or other publicly viewable portion of a building.

In one embodiment, the present invention provides a heat exchanger, comprising: a supply header pipe; a return header pipe; and a set of exchange tube coils, each comprising a tube connected between the supply header pipe and the return header pipe and arranged in a coil.

The present invention also includes a backbone support configured to support the exchange tubes in a horizontal manner.

The present invention includes methods of constructing and installing the heat exchanger.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
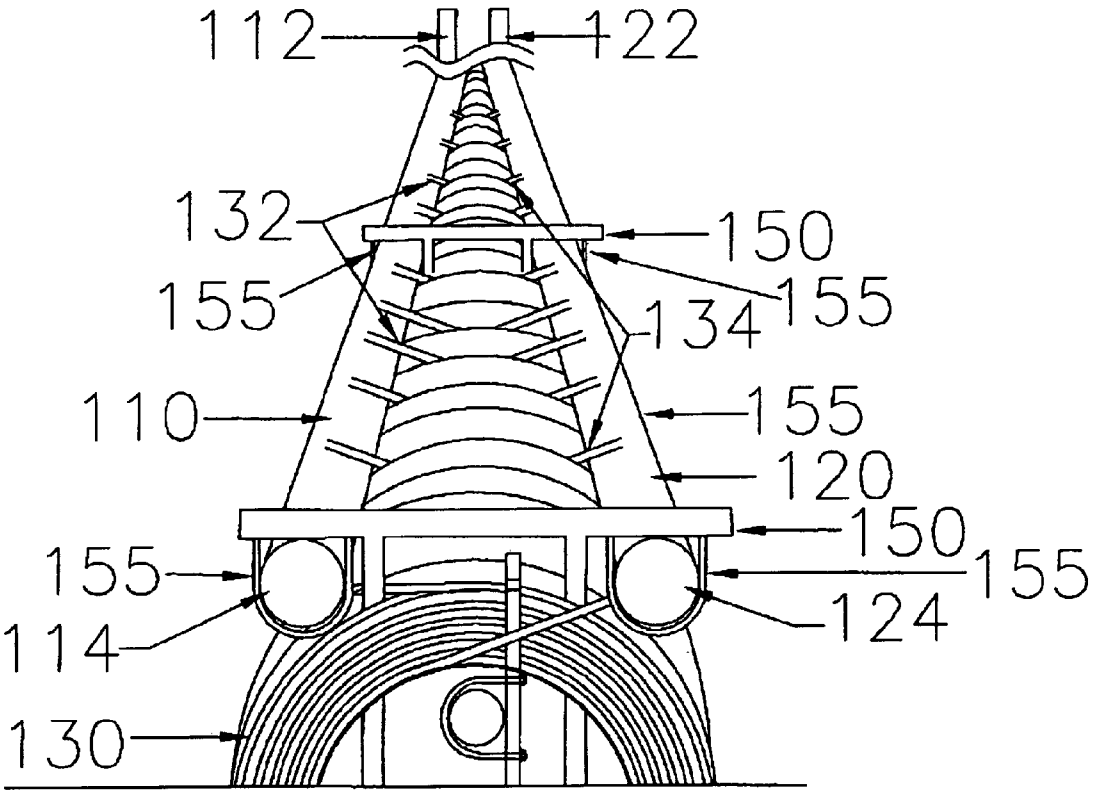
FIG. 1 is an illustration of an embodiment of a heat exchanger according to the present invention.

Referring now to the drawings, wherein like reference numerals designate identical or corresponding parts, and more particularly to FIG. 1 thereof, there is illustrated a drawing of an embodiment of a heat exchanger 100 according to an embodiment of the present invention.

The heat exchanger 100 is a horizontally constructed heat exchanger that includes a supply header tube 110, a return header tube 120, and a plurality of exchange tube coils 130. The exchange tube coils 130 are attached at an exchange tube supply end 132 to the supply header tube 110 and at an exchange tube return end 134 to the return header tube 120.

Each header tube includes a connection end (supply connection end 112, and return connection end 122) that is attached to a source device that produces a fluid that is to be cooled. An end of each header tube opposite to the connection end, referred to as a stopped end (supply stopped end 114 and return stopped end 124), has a cap fitted to the exchange tube that prevents fluid from leaving the heat exchanger. The fluid is pumped into the supply header tube at the connection end, circulates toward the stopped end of the supply header tube, through the exchange tube coils, and is then extracted from the connection end of the return header tube. While circulating through the header tubes and exchange tube coils, the fluid is cooled.

The exchange tube coils 130 are constructed with an unspecified number of turns, but should have a number of turns, or length such that they:

1. adequately dissipate an amount of heat produced by the attached system;
2. can be supported considering the length of the heat exchanger and supporting structures internal/external to the heat exchanger and a foundation on which the heat exchanger will be mounted; and
3. do not exhibit too much flow restriction considering pumping power of the attached system and/or any pump boosters that may be attached in line within or external to the heat exchanger.

The present inventors have determined that the coils are spaced at approximately 1 foot intervals along the backbone which appeared through experimentation to be optimal given the length of the coil tubing and outside diameter of the coils. Each coil has a number of turns dependent on the overall length of the coil tubing and diameter of the coils (300' length and 48" coil, for example). The coil tubing is preferably high density polyethelene, commonly known as HDPE, which was chosen for durability and cost effectiveness. However, other materials may be utilized, such as copper, other polymer materials, stainless steel or other alloy steels. Also, other lengths, diameters, and pother measurements of the components making the finished product may be utilized.

Preferably, the exchange tube coils are mounted in a horizontal arrangement. The horizontal construction and installation makes the present invention ideal for placement under existing waterfront buildings, piers, buildings constructed on piers, offshore platforms, bridges, barges, and other water based platforms.

The horizontal construction and subsequently described mounting makes for a very secure heat exchanger that is capable of withstanding strong currents, wakes, and tidal flows that are often present in waterfront and water based environments. Construction of the header tubes and exchange tube coils from polymer materials makes the heat exchanging elements rugged enough for the harsh marine environment.

Figure 2:
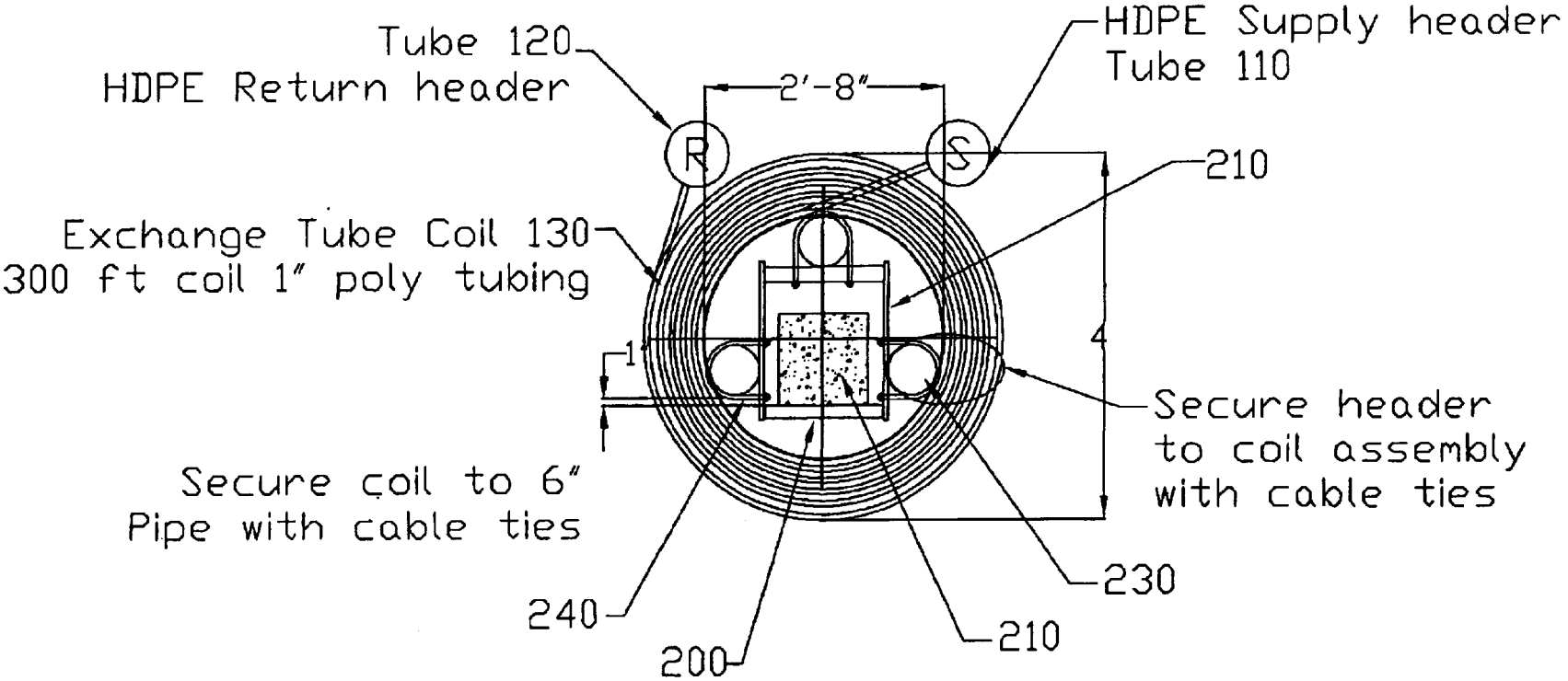
FIG. 2 is a detail drawing illustrating an end view of an embodiment of the present invention.

FIG. 2 is a detail drawing illustrating an end view of an embodiment of the present invention. An internal structure is provided to make the heat exchanger rigid in a horizontal direction, providing a basis for support of the heat exchanging elements. The internal structure is shown in FIG. 2 as backbone 200. The backbone 200 includes a horizontally placed rigid structural member 210. Preferably, the rigid structural member is a reinforced concrete pile.

Backbone brackets 200 are attached to the rigid structural member 210 at evenly spaced intervals. In the embodiment shown, the backbone brackets are spaced at 15', which was determined by experimentation. However, other spacings or intervals could also be utilized. The backbone bracket is a frame preferably constructed from a stainless steel or other material able to withstand a marine or underwater environment (e.g., fiberglass, carbon steel with an appropriate coating, or steel/nickel alloys, for example). Grade 316 stainless steel was selected because it offered a balance between cost and durability as well as being maintenance free. The maintenance free aspect of the material is important because, in at least one embodiment, the heat exchanger is mounted under water which makes accessibility for regular maintenance, including coating inspection and repair, difficult. The backbone brackets provide spacing between the rigid structural member 210 and the exchange tube coils 130.

Exchange tube supports 230 are horizontally placed in a same general longitudinal direction as a center axis of the heat exchanger and the rigid structural member 210. The exchange tube supports are attached to the backbone bracket 220 and enforce the spacing between the rigid structural member 210 and the exchange tube coils 130, and provide support for a minimum inside diameter of each turn of the exchange tube coils.

The exchange tube supports 230 are secured to the backbone bracket via exchange tube support attachments 240. In this embodiment, the exchange tube support attachments are stainless steel U-bolts, the exchange tube supports are 6" diameter polyethelene pipe, and the exchange tube coils are secured to the exchange tube supports via cable ties. The cable ties are constructed of nylon or other durable material. Other mechanisms may also be utilized to attach the exchange tube supports 230 and secure the exchange tube coils thereto. For example, the exchange tube supports may be bolted, glued (e.g., epoxy) or otherwise attached to the backbone bracket 220. A clamping mechanism may be used to attach either the exchange tube supports to the backbone bracket, or to secure the exchange tube coils to the exchange tube supports. Other methods of attaching the various structural components described herein may also be utilized and it is intended that any other attaching mechanism known, whether or not described herein, may be substituted and not depart from the spirit and intended scope of this patent.

Preferably, three exchange tube supports are utilized, and arranged as shown in FIG. 2. A first exchange tube support on a top side of the backbone bracket, and two additional exchange tube supports at each side near a bottom of the backbone. No exchange tube support is provided at the bottom of the backbone to facilitate ease of installing the heat exchanger on a cross support or other foundation. The rigid structural support is attached at the bottom end of the backbone bracket so that it will be firmly connected to the cross support or other foundation supporting the installed heat exchanger.

The purpose of the exchange tube support is to secure the exchange tubes and enforce an approximate minimum distance between the rigid structural support member and the exchange tubes. Therefore, alternative configurations of exchange tube supports may be utilized. For example, two exchange tube supports may be utilized at opposite sides of the support bracket.

A single exchange tube support may also be utilized, but, in such an arrangement, additional rigidity supporting the exchange tube coils will be required if the heat exchanger is installed in an area with any currents or tidal action. In this case, unacceptable twisting of the exchange tubes or chaffing against the rigid structural member is likely. Therefore, the three exchange tube supports described above, enforcing approximately 2'8" minimum diameter of the exchange tube coils, provides for solid support, good circulation of water within the exchange tube coils, and sufficient separation between the inside of the exchange tube coils and the rigid structural member to prevent chaffing.

In one embodiment, two of the exchange tube supports perform double duty and also function as the supply and return headers. In this embodiment, the exchange tube supports that also function as supply and return headers include connections to each of the exchange tube coils, and the coils are fed/returned heat exchange fluid to/from inside the exchange tube coils. In other alternative embodiments, the exchange tube supports are outside the exchange tube coils and then feed/retrieve heat exchange fluid to/from the coils from outside the exchange tube coils.

Returning now to FIG. 2, the backbone bracket 220 is preferably a rectangular frame having one side attached to the rigid structural member. The rigid structural support preferably is a square concrete pile, and a flat bottom side of the backbone bracket is attached to a flat side of the square concrete pile. Attachment to the concrete pile may be made with anchor bolts (preferably stainless steel, but could be hot dipped galvanized steel, referring to a zinc coating applied to steel to resist corrosion, or other durable material) embedded in the reinforced concrete pile. concrete bolts, epoxy bolts, a clamping device, or other attachment mechanisms. Preferably the attachment is made with friction anchors or epoxy anchors.

The present inventors have determined that a heat exchanger with a length of approximately 65 feet that will be supported on at least two points, that the rigid structural member is best constructed as a 12"×12" reinforced concrete pile. However, it should be noted that many other types of backbones could be used other than a concrete pile. However, the pile was chosen because it is particularly cost effective compared to other materials (steel, composites like fiberglass or other fiber structural members), readily available, and it has inherent mass thereby allowing the unit to achieve neutral buoyancy. Neutral buoyancy is an important feature in making the installation process proceed smoothly (see installation notes below).

One of the other hallmarks of the linear design is that it is expandable when it is constructed in the parallel flow embodiment. Additional units could be added onto the end of the unit by simply connecting them together at the supply and return headers (e.g., see FIG. 13).

Alternatives to the backbone bracket 220, include extending the bolted end of the U-bolt embodiment of the Exchange tube support attachments directly to the rigid structural member 210, and the exchange tube supports are then bolted or otherwise attached at opposite ends. Another alternative is to use a support bar attached at one end to the rigid structural support member, the support bar extending outward from the rigid structural member, and having an exchange tube support attachment fixed at a second end of the support bar. However, the backbone bracket and exchange tube supports described above is preferred for durability, support, and ease of construction.

Figure 3A:
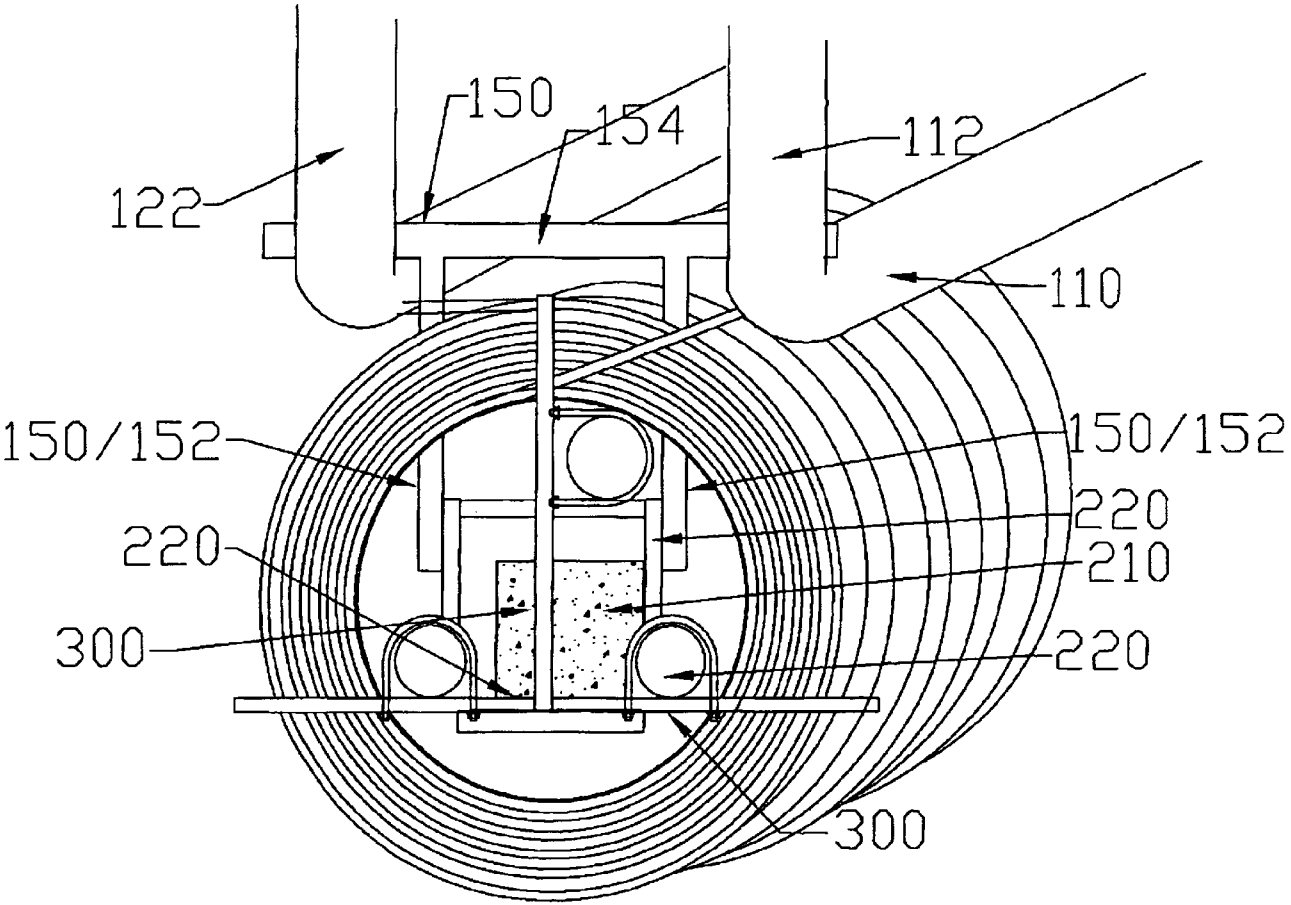
FIG. 3A is an illustration of an end view of an embodiment of the present invention.

FIG. 3A is an illustration of an end view of an embodiment of the present invention. FIG. 3A represents an as built embodiment, including the rigid structural member 210, backbone bracket, exchange tube supports 220, return connection end 122, supply connection end 112, and supply header tube 110. In this illustration, the rigid structural member is a square concrete pile laid horizontally. The concrete pile is abutted in a corner of the rectangular backbone bracket 220. In this embodiment, the concrete pile has attachment points on the two sides of the backbone bracket that meet at the corner in which the concrete pile is abutted.

Preferably, the header tubes 112 and 122 are also secured to the rigid structural support member. In one embodiment, a header tube support bracket is attached directly to the rigid structural support member. However, in the embodiment of FIG. 3A, a header tube support bracket 150 is secured to the backbone bracket 220. One advantage of using the backbone bracket to secure additional brackets and fittings as compared to using the rigid structural support member is that less attachments need to be made to the rigid structural support member.

In this embodiment, the header tube support bracket 150 comprises a T shaped bracket having two legs 152 and a top cross bar 154. The two legs 152 each attach to opposite sides of the backbone bracket at one end and are connected to the top cross bar 154 at another end. The top cross bar 154 includes one or more hanger devices for securing the header tubes to the header tube support bracket. In the embodiment of FIG. 3A, a pair of header tube hangers (e.g., header tube hanger 155) are positioned at opposite ends of the top cross bar 154 and are constructed from U-bolts of a size matching the size of the header tube.

FIG. 3A also illustrates an end cap 300 used to fully secure and position exchange tube coils 130 that are at an end of the heat exchanger. The end cap 300 provides additional support to assure that the exchange tube coils at the end of the heat exchanger maintain their position relative to the backbone and other coils. Maintaining the position of the end exchange tube coils prevents additional stress being placed on fittings used to attach the exchange tube supply and return ends to the header tubes.

The end cap comprises a frame that is mounted from an interior portion of the heat exchanger and extends to a point beyond an outside circumference of the exchange tube coils. Preferably, the end cap includes a longitudinal piece 800 (see FIG. 8) that also extends out over at least a portion of the exchange tube coils. In FIG. 3A, the end cap 300 is embodied as a T frame where each end of the T extends just past an outside circumference of the exchange tube coils. Each end of the end cap T also has a longitudinal piece 800 (see FIG. 8) that extends over a portion of the exchange tube coils. The end cap 300 is attached to the exchange tube supports using U-bolts. However, other attachment devices may be utilized (bolts, clamps, or ties, for example).

An advantage to attaching the end cap to the exchange tube supports is that the backbone need not extend to the very end of the heat exchanger to provide a mounting spot for the end cap. However, since the exchange tube supports do run to the end of the heat exchanger, they may be utilized to secure the end cap. Alternatively, with an extended backbone or backbone bracket, other attachment devices and other attachment points may be utilized (bolting the end cap to the backbone or backbone bracket, for example).

Figure 3B:
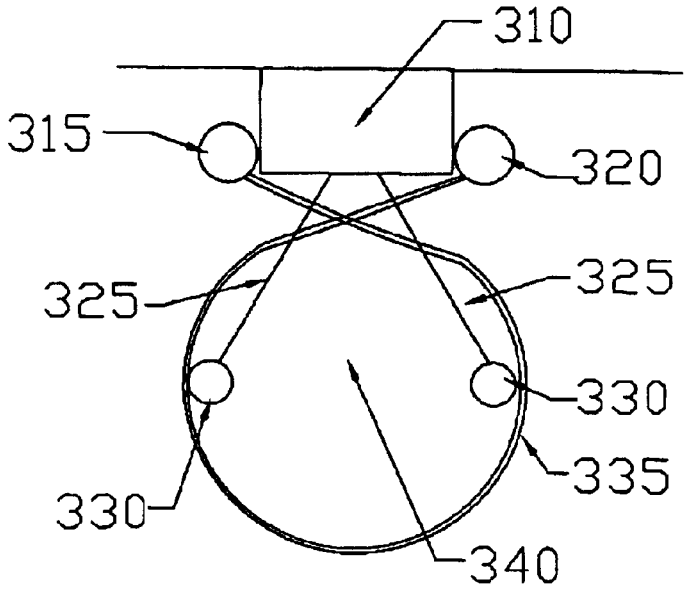
FIG. 3B is a drawing of an end view of another embodiment of the present invention.

FIG. 3B is an illustration of an end view of an alternative embodiment of the present invention. A backbone 310 (constructed of concrete, steel, steel alloy, or other material) supports header supply 315 and return 320 tubes. Spacing bars 325 are attached to the backbone 310 and secure exchange tube supports 330. Coiled exchange tubes 335 are coupled between the supply and header tubes and include one or more wraps (coils) around the exchange tube supports 330. In one embodiment, a cross spacer support 340 is installed securing the spacers 325.

Figure 3C:
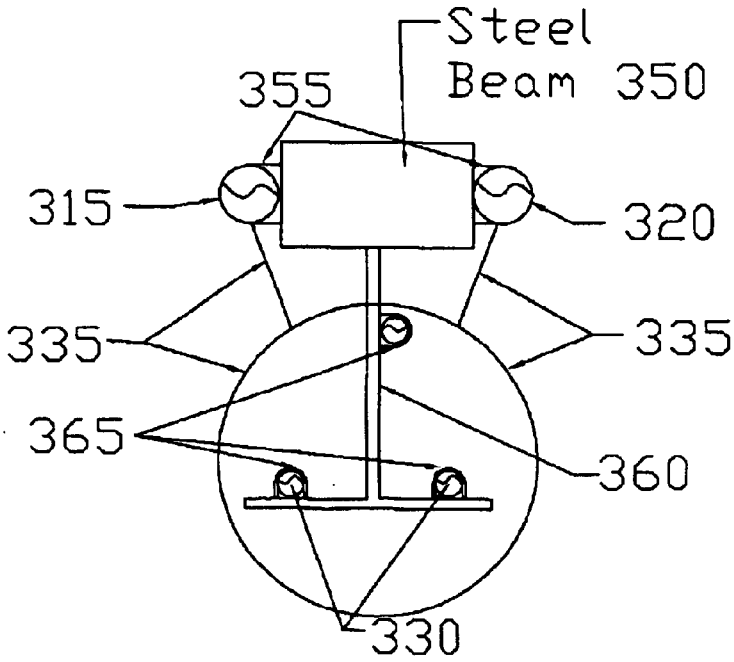
FIG. 3C is a drawing of yet another embodiment of the present invention.

FIG. 3C is a drawing of an end view of another alternative embodiment of the present invention. A steel beam 350 has brackets 355 that attach to the supply 315 and return 320 header tubes. A T-bar 360 is also secured to the steel beam 350 and has brackets 365 that hold exchange tube supports 330. Coiled exchange tubes 335 are coupled between the supply and header tubes and include one or more wraps (coils) around the exchange tube supports 330. The steel beam 350 can function as a backbone laterally supporting the heat exchanger, or, the steel beam 350 can be attached to a backbone such as a concrete pile as discussed above.

Figure 4:
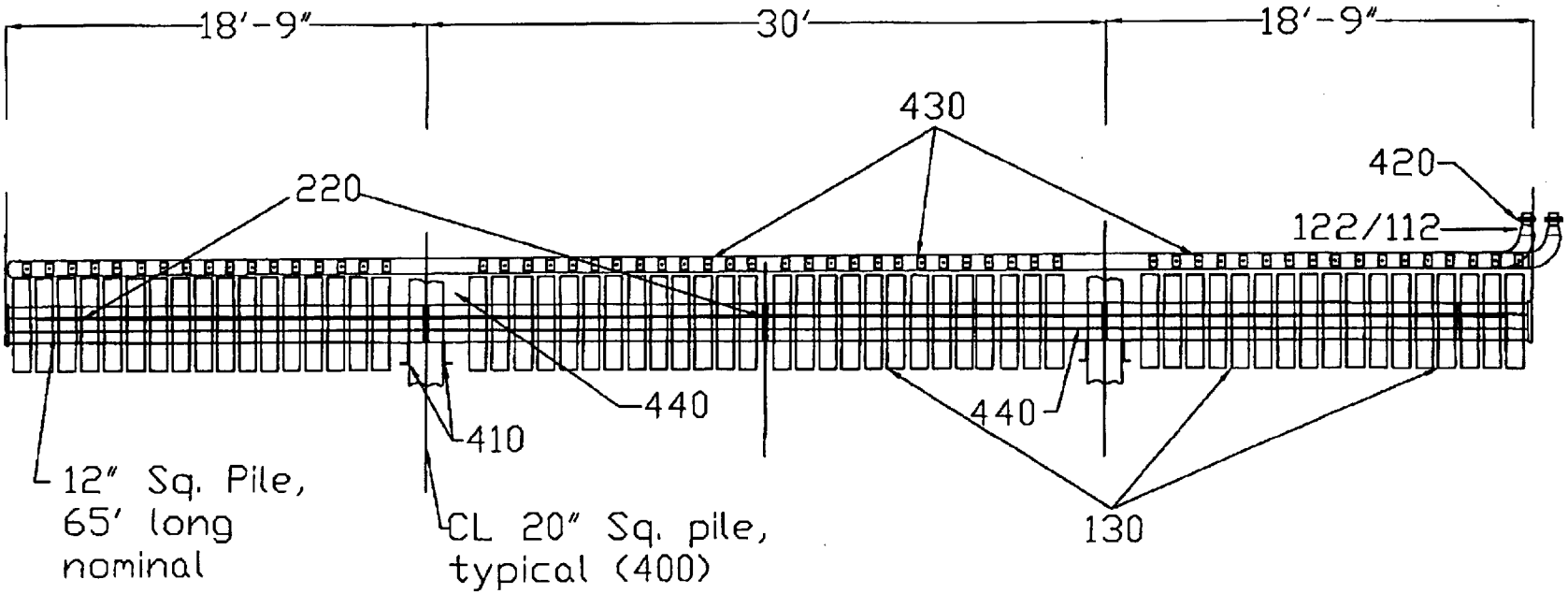
FIG. 4 is a drawing of a side view of an embodiment of the present invention illustrating pier attachment points and other features.

FIG. 4 is a drawing of a side view of an embodiment of the present invention illustrating pier attachment points and other features. The rigid structural member 210 is shown as a 12" square concrete pile. Exchange tube coils are spaced at approximately 1' intervals, and backbone brackets 220 are attached at approximately 15' intervals. Supply and return headers 110 and 120 run above the coils and exchange tube fittings 430 mate the exchange tube coils at exchange tube supply ends to the supply header tube and exchange tube return ends to the return header tube (see FIG. 10 for an example fitting).

Supply connection end 112 and return connection end 122 each have connection end fittings 420 for attaching the heat exchanger to a riser that supplies and returns fluid to the source device(s). Channels 410 attached to pier piling 400 support one or a cross piling support member 500 (see FIGS. 5 and 6) that is also attached to the pier. The cross piling support member supports the backbone at coil free intervals 440.

Figure 5:
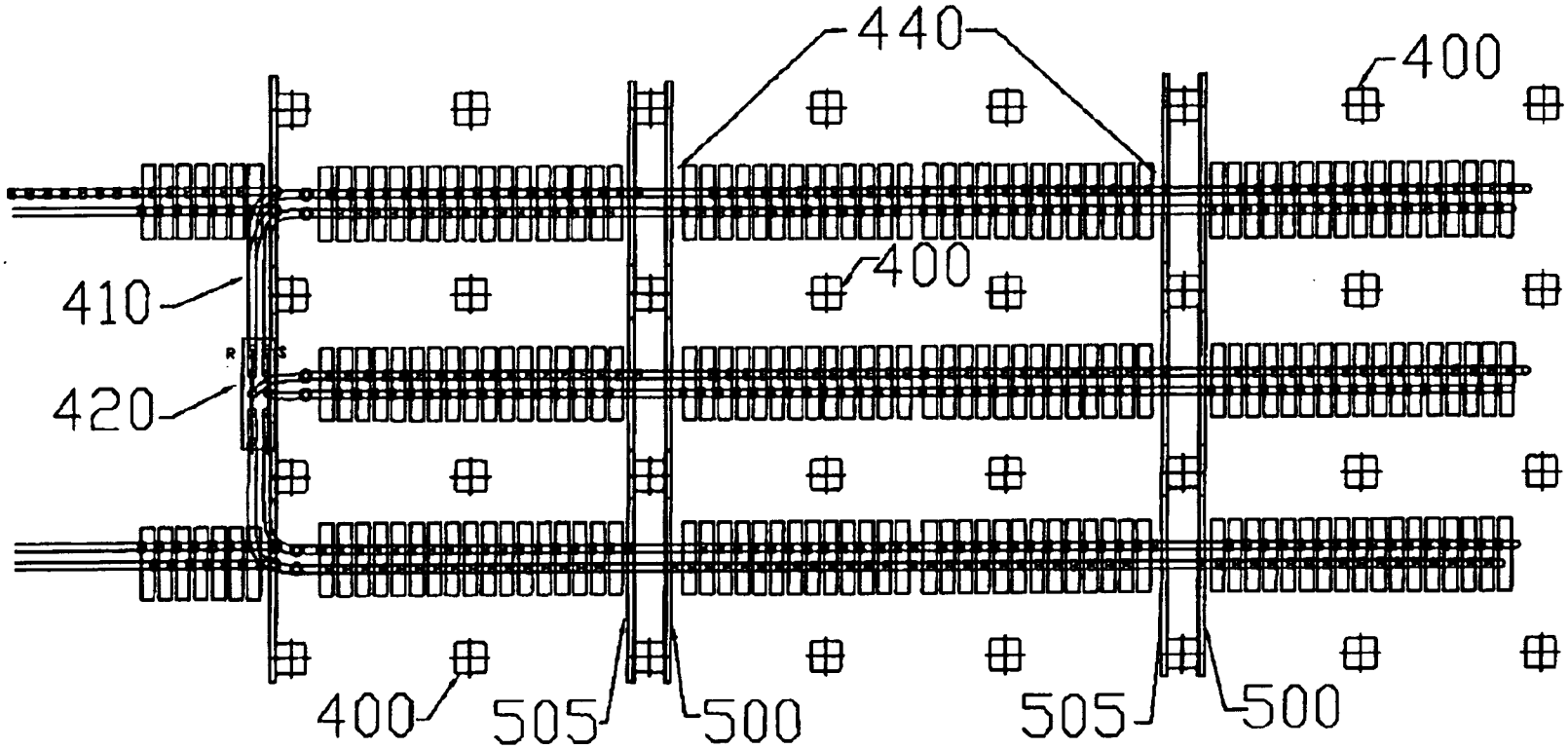
FIG. 5 is a drawing of a top view of the present invention installed between support pilings of a pier.

FIG. 5 is a drawing of a top view of the present invention installed between support pilings of a pier. Pier pilings 400 are typically spaced at even intervals and aligned with long and perpendicular axis' of the pier. Cross piling support members are attached to pier pilings 500 that are in line (perpendicular to long axis of the pier) with a corresponding set of coil free intervals 440. Alternatively, the heat exchangers could be installed using similar channels and cross member supports arranged with the long axis of the pier. However, the arrangement in FIG. 5 is considered better because the long axis of the pier matches the longitudinal axis of the heat exchangers and the coils derive more benefit from currents that often run parallel to the shoreline from which the pier extends.

FIG. 5 illustrates 5 heat exchangers consistent with the present invention. Riser tubes 410 connect each of the supply connection end 112 and return connection ends 122 to a supply and return manifold 420. The supply/return manifold 420 feeds fluid to and from the source device to the riser tubes 410.

Figure 6:
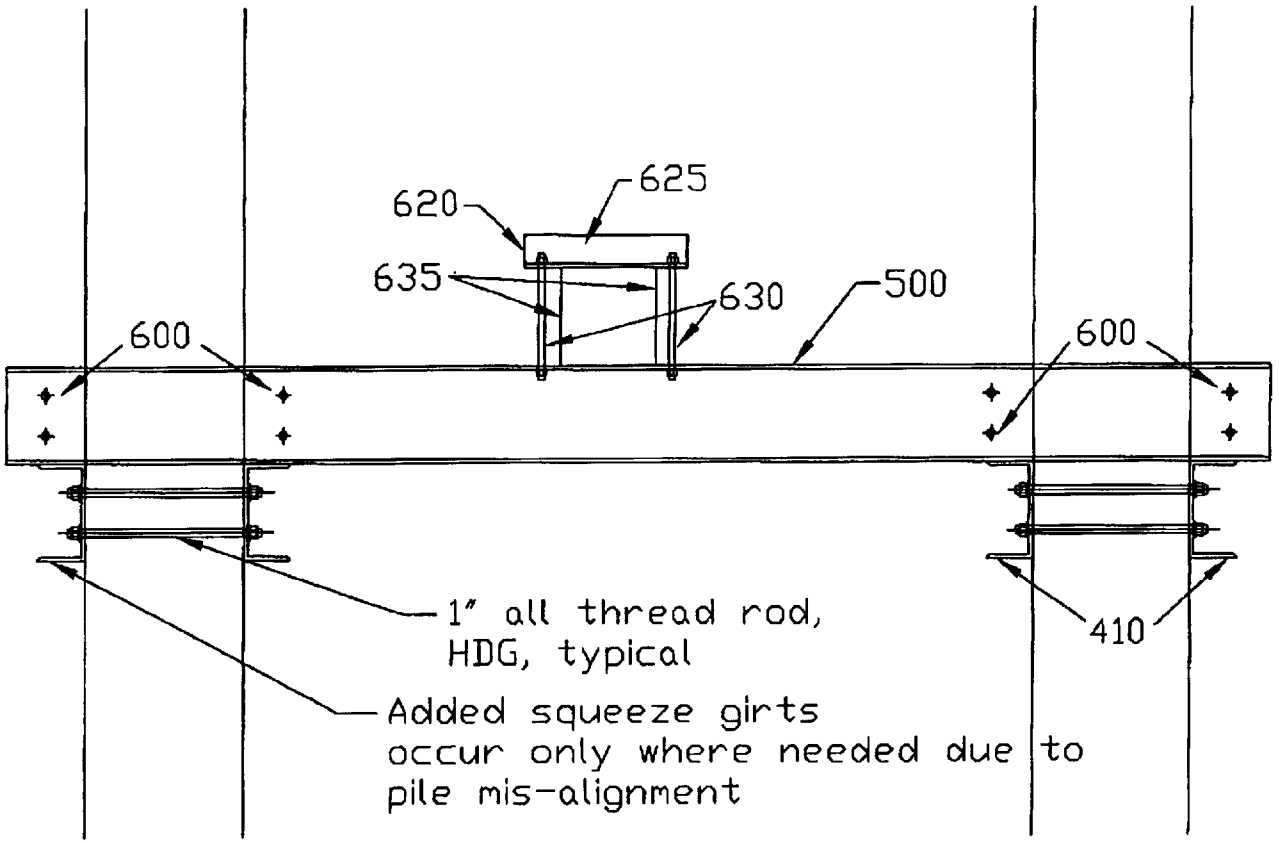
FIG. 6 is a drawing of a heat exchanger support securing mechanism according to an embodiment of the present invention.

FIG. 6 is a drawing of a heat exchanger support securing mechanism according to an embodiment of the present invention. Support for the heat exchanger comes from the cross piling support member 500. The Cross piling support member is supported on channels 410 attached to the pier pilings. The channels are mounted with the channel open end facing away from the pier piling and are secured to the pier piling via threaded rods and bolts. The c ross piling support member 500 rests across and on top of at least two channels fitted to two different pier pilings. Preferably, the channels are bolted to another channel on an opposite end of the pier piling. The support channels (channels 410 are support channels) are preferably a length equivalent to a width of the pier piling plus additional length approximately equivalent to a width of the cross member supports that are supported by the channel.

The cross piling support member may also be constructed from channel materials, but elongated to traverse at least two pier pilings. A matching cross member support member (505, see FIG. 5) is placed on an opposite side of the pier pilings and bolted (note bolts 600) to the cross piling support member 500.

Sometimes pier pilings are incorrectly aligned due to installation errors, non-uniform soil or other material into which the piers are driven during installation, and/or wave or tidal action affecting the pile driving process. In the case of mis-aligned pier pilings, squeeze girts (device for attaching to a square piling by using parallel members, which can be wood, steel, etc, which are clamped together around the piling by using long bolts) are placed between the channels and the pier piling to assure solid contact and a secure fitting to the pier piling. Friction between the squeeze girt members and piling resist and forces applied to the squeeze girts by the cross piling support member.

The cross piling support member includes a backbone securing mechanism 620 to secure the backbone to the cross piling support member. In this embodiment, the backbone securing mechanism 620 is a clamping mechanism including a holding bar 625 and clamping bolts 630. The rigid structural member 210 fits under the holding bar and between the clamping bolts which fasten the holding bar tight against a top side of the rigid structural member. Side bars 635 may also be utilized.

Preferably, the channels, cross piling support members support members and bolts are constructed of hot dip galvanized steel. Alternatively another non-corrosive or corrosion resistant material may be utilized (stainless steel, etc.). All metal to metal connection should be of the same type of metal, and preferably manufactured from material having identical properties.

Alternatively, support for the heat exchanger may be found through a foundation, pedestal or other supporting member attached to the pier pilings or secured to an earth or seabed floor under the pier.

Figure 7:
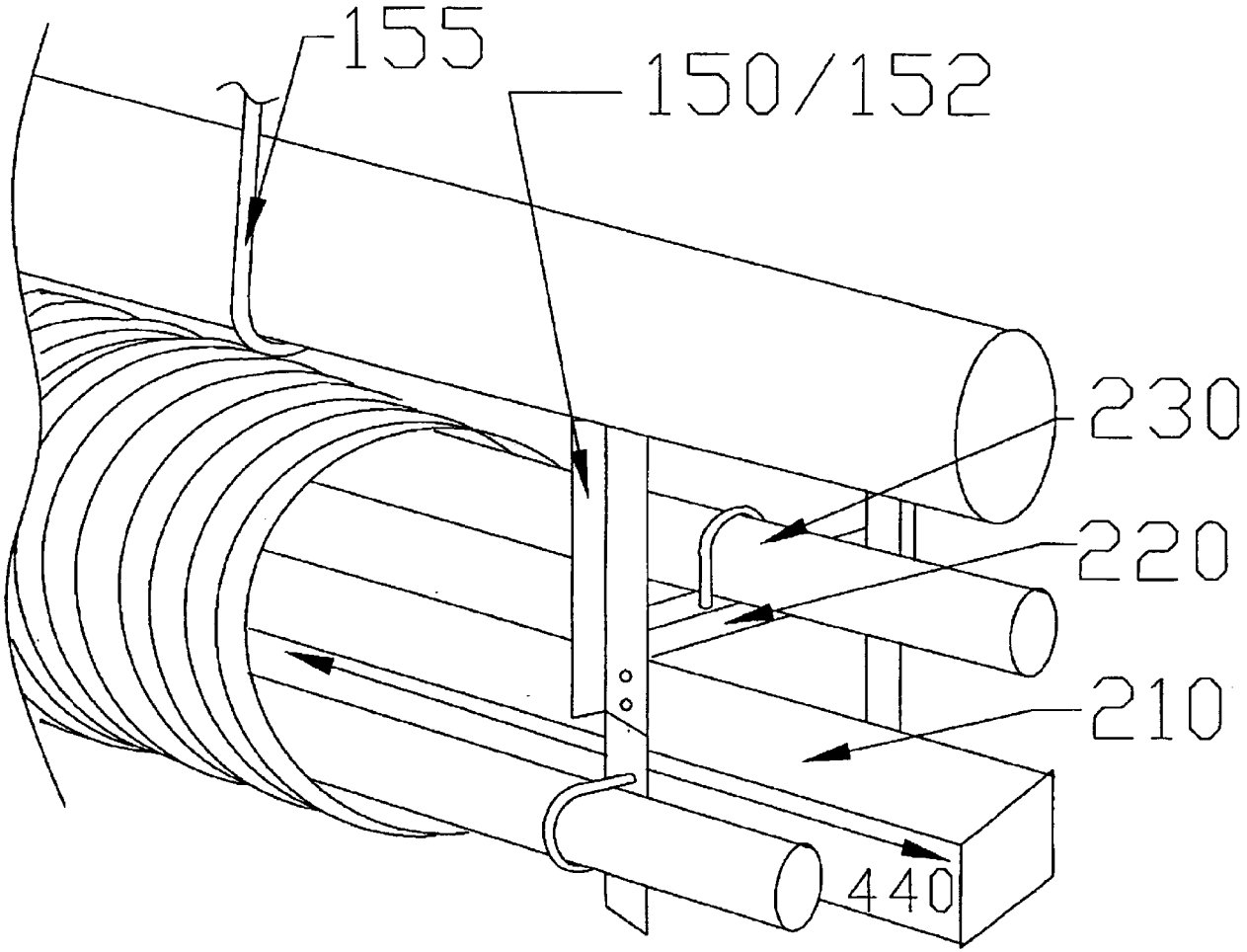
FIG. 7 is an illustration of an angle view of a backbone, and installation support area for attaching the heat exchanger to a support beam.

FIG. 7 is an illustration of an angle view of a backbone, and installation support area (free interval 440) for attaching the heat exchanger to a supporting beam or column. Holding block 700 illustrates the approximate position of the cross piling support member in a typical installation.

Figure 8:
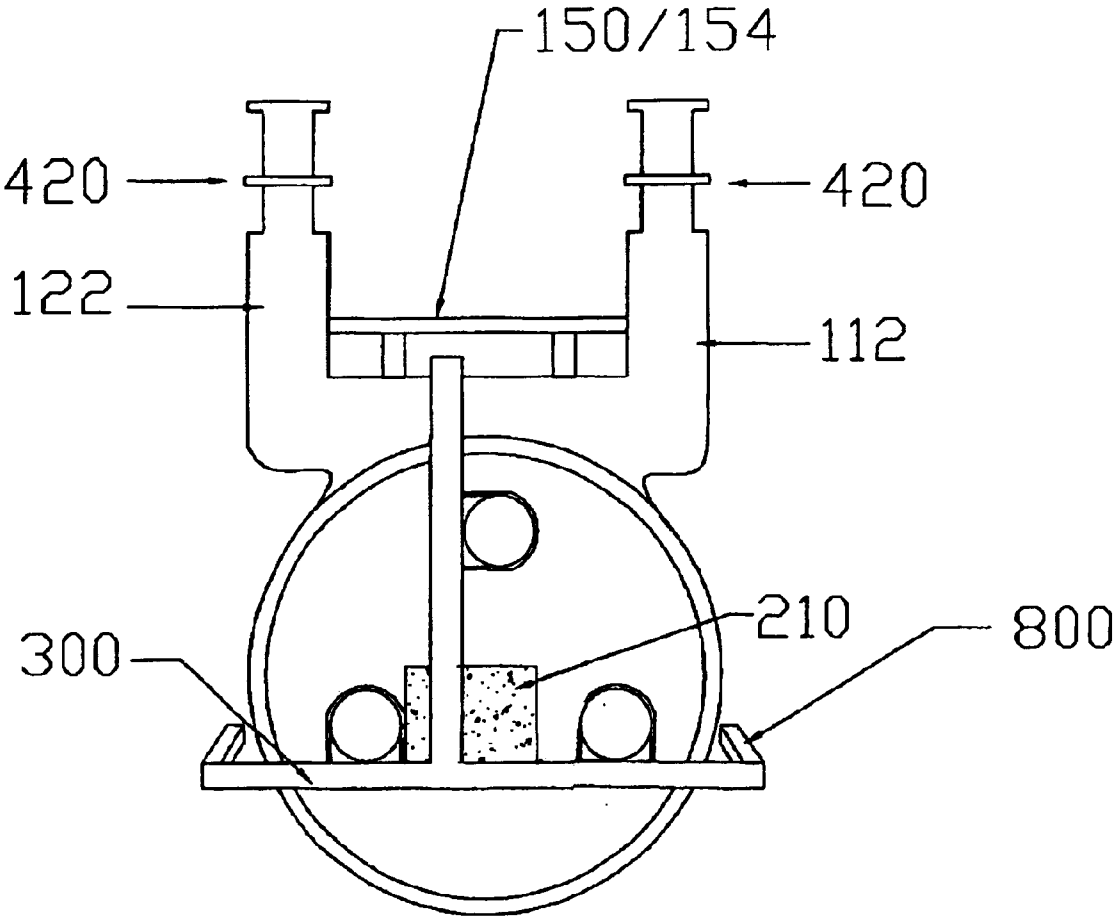
FIG. 8 is drawing of a riser end view of an embodiment of the present invention.

FIG. 8 is drawing of a riser end view of an embodiment of the present invention. FIG. 8 includes fittings 420 used to attach the return connection end 122 and supply connection end 112 to corresponding riser tubes (410, for example). The header tubes are inclined at the connection end relative to the stopped end to facilitate removal of air from the system (heat exchanger). The inclination may be performed by installing the stopped end at a slightly lower elevation than the connection end. Alternatively, the header tube support brackets may be incrementally taller starting at the stopped end and increasing in height as the connection end is approached. Preferably, the header tubes are inclined at 1% with a high point at the connection point (top of connection ends 112 and 122).

Figure 9:
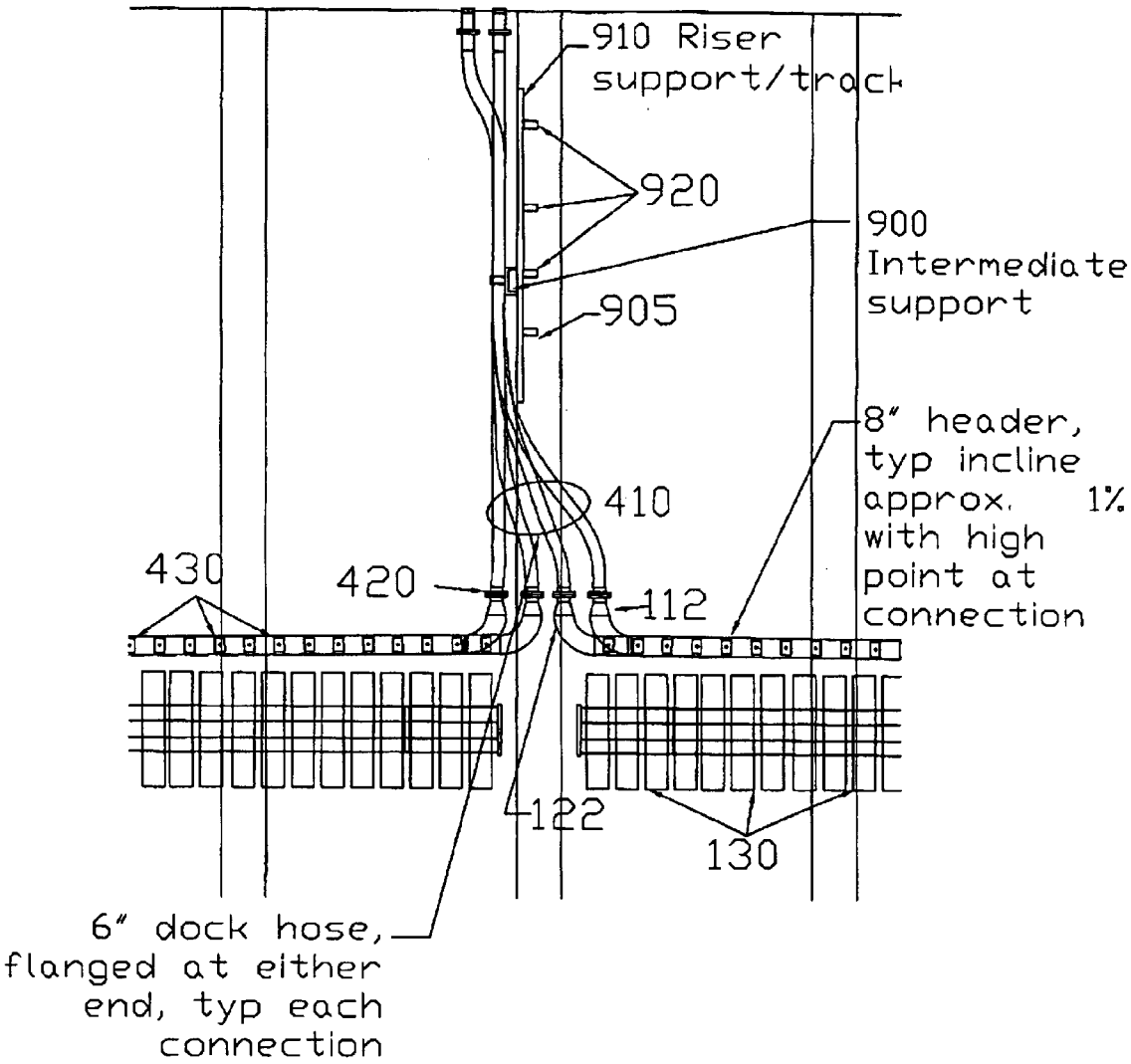
FIG. 9 is a drawing of a riser arrangement according to an embodiment of the present invention.

FIG. 9 is a drawing of a riser arrangement according to an embodiment of the present invention. Corresponding supply and riser tubes 410 attach to fittings 420 at connection ends 112 and 122. The riser tubes are supported by at least one intermediate support 900. The riser tubes may be constructed of dock hose, 6' in length and flanged at the ends (flanges mating with fittings 420, for example), but other materials and connections may be utilized.

The intermediate support comprises a clamping mechanism configured to hold one or more of the riser tubes 410. The intermediate support is secured to a beam 905 of the pier by bolting to one or more bolting holes 920 drilled in the beam. Alternatively, a track 910 is attached to the pier, the track including mounting holes for attaching the intermediate support, or a slidable groove that slidably accepts a portion of the intermediate support 900. In the track embodiment, a securing mechanism (bolt, brake, etc) is utilized to secure the intermediate support at a fixed position in the track groove. The move-ability of the intermediate support (via track or mounting holes) simplifies installation on piers and other structures that are not necessarily built to similar dimensions and standards.

Alternatively, instead of using the flexible riser arrangement described above, the supply an return headers may be hard-piped (running fixed pipes between the source device (s) and the header tubes—HDPE pipe, for example).

Figure 10:
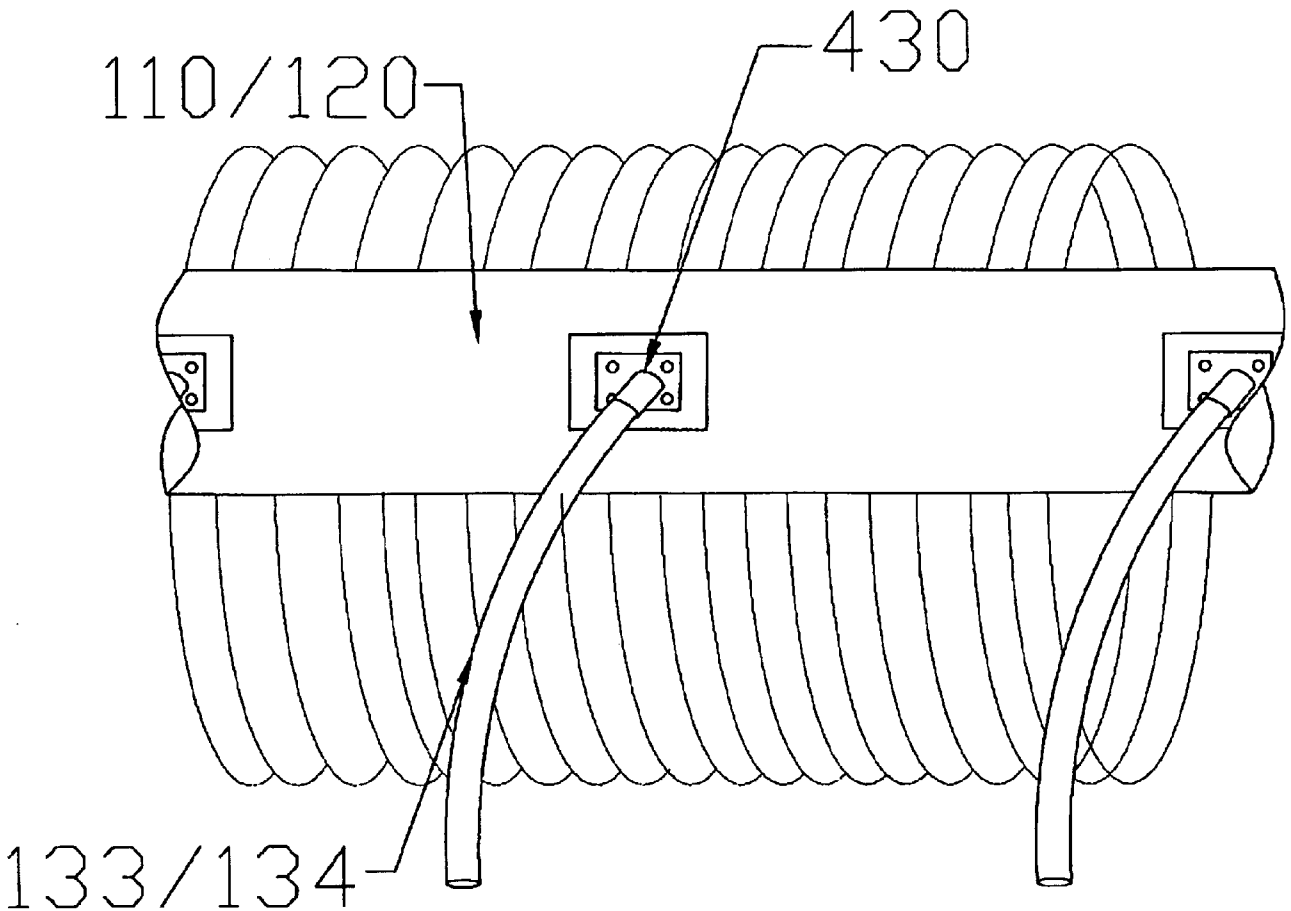
FIG. 10 is an illustration of a fitting used in an embodiment of the heat exchanger according to the present invention.

FIG. 10 is an illustration of an example exchange tube fittings 430. The fitting is mounted on a header tube (supply or return) and mates the exchange tube coils at exchange tube supply end to the supply header tube and at exchange tube return ends to the return header tube.

The backbone and layout of the heat exchanger is aptly described as a linear configuration. The heat exchanger supply and return headers themselves can be constructed any of several different arrangements and still be used in the linear backbone configuration. Two additional types of general configurations of the headers is now described.

Figure 11:
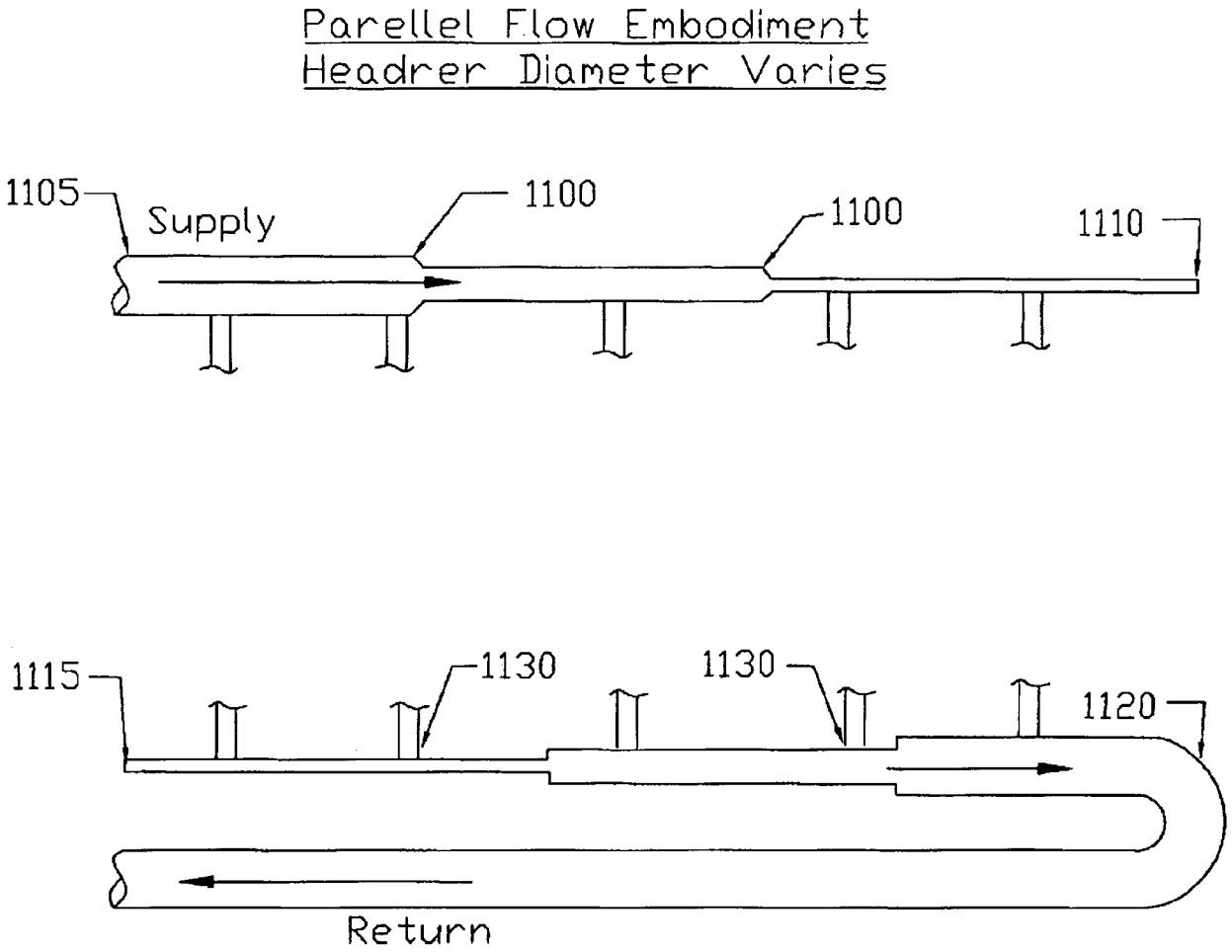
FIG. 11 is an example of a parallel flow varying diameter header according to an embodiment the present invention.

1. Parallel flow, varying diameter header—Referring to FIG. 11, in this type of construction, the supply header's diameter reduces in a step-fashion along the length of the heat exchanger via diameter reductions 1100 of the supply header and diameter increases 1130 in the return header. The largest diameter would be at the beginning 1105, running to smallest at the end 1110. The return header is oriented exactly opposite: The largest diameter is at the end 1120, opposite the smallest supply diameter. The return header then gets smaller as it goes toward the supply end 1115. The term "parallel flow" means that the supply and return flows are in same direction. In order to make the supply and return connections at one end of the unit, one or the other header (most commonly the return) is directed back toward the other end with a 180 degree bend and a length of straight pipe.

This arrangement seeks to equalize the flow and pressure along the entire length of the headers.

Figure 12:
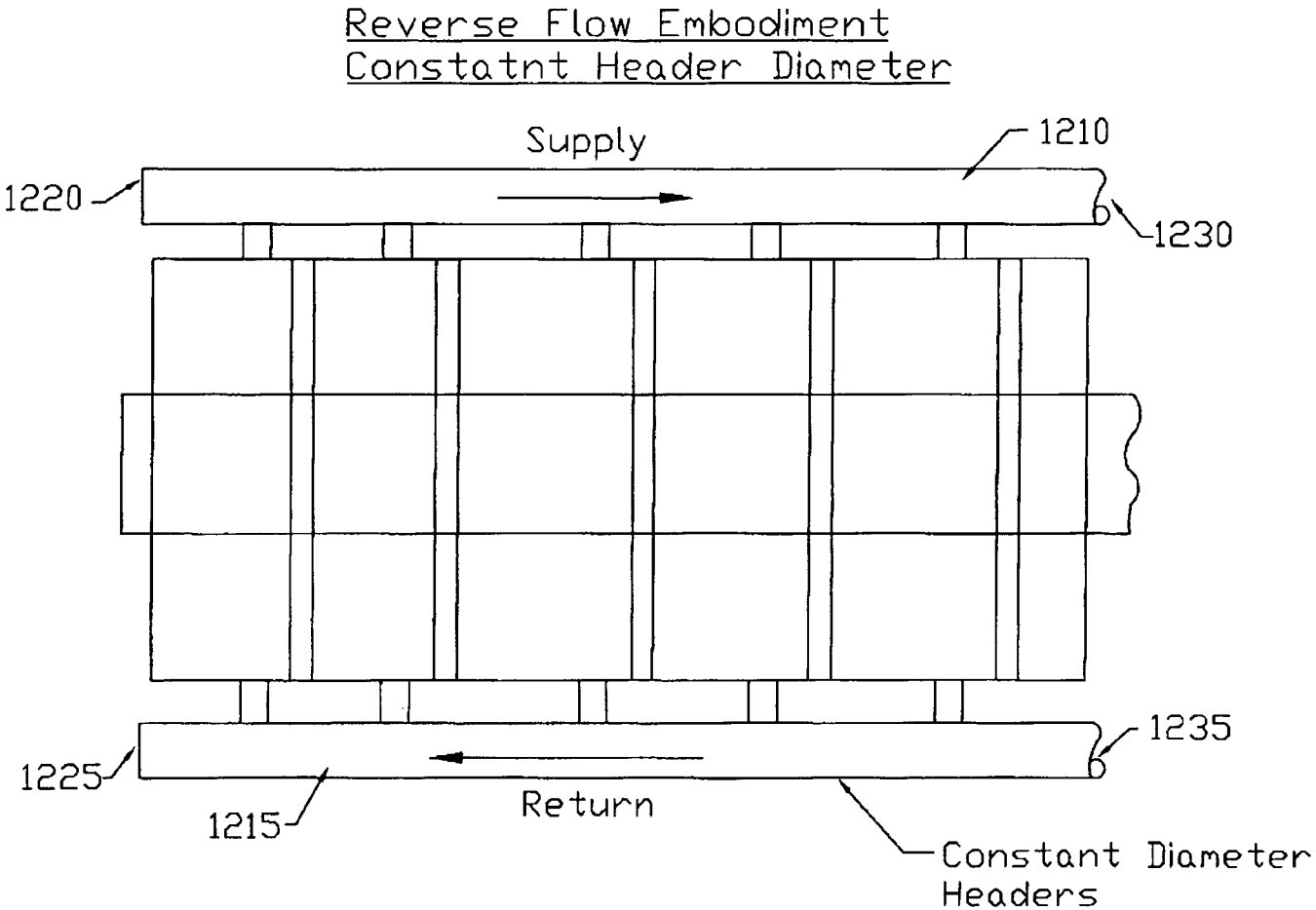
FIG. 12 is an example of a reverse flow constant diameter headers and an expansion unit according to an embodiment of the present invention.

2. Reverse flow, constant diameter header—This is the presently preferred embodiment of the invention. Referring to FIG. 12, in this scheme, the supply (1210) and return (1215) headers have a constant diameter along their entire lengths. The term "reverse flow" is used because the supply flow is in the opposite direction as the return flow. Because of this, supply and return connections can be located at one end (1220/1225) of the heat exchanger without the added expense of running one of the lines back to the other end of the unit.

In one embodiment, the ends of both the supply and return headers are flanged with a blind flange instead of capped. The blind flanges permit expansion by simply removing the blind flange and bolting on another unit. Other types of connections or permanent piping may also be used to connect added units. Connections at an opposite end (1230/1235) of the headers may be conveniently utilized to attach an expansion unit to increase capacity of the heat exchanger.

Figure 13:
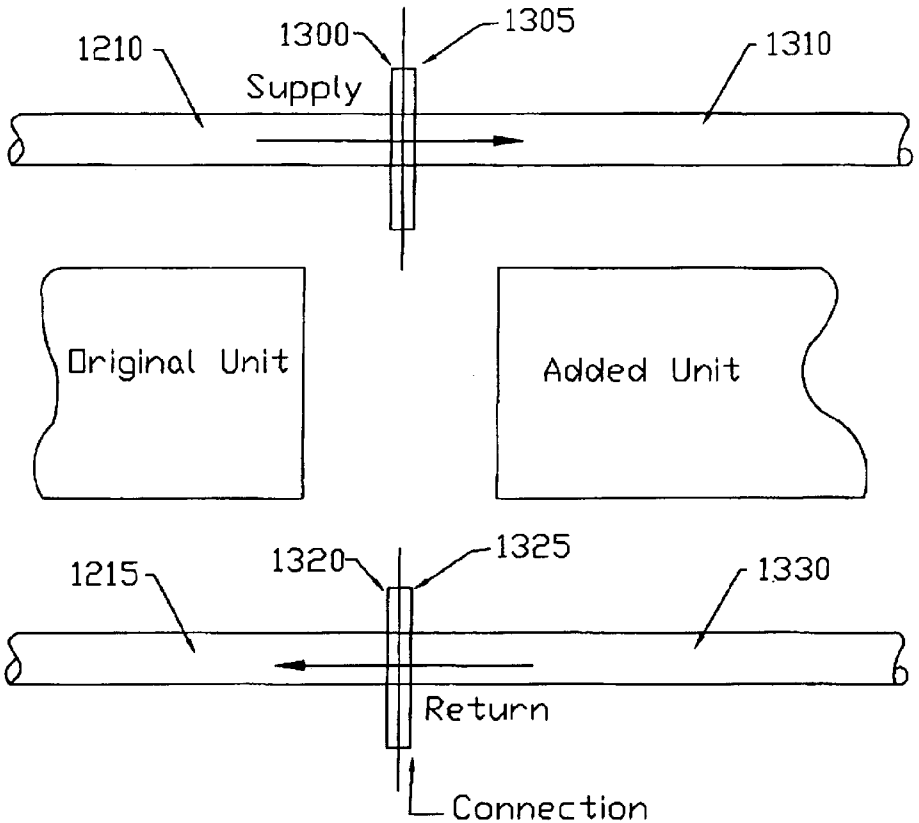
FIG. 13 is an example connection arrangement between a first heat exchanger and an expansion heat exchanger according to an embodiment of the present invention.

Thus, referring now to FIG. 13, end of supply header 1210 of a first heat exchanger has a connector 1300. The connector 1300 couples to a connector 1305 at a beginning of a supply header 1310 of an expansion unit. Similarly, using connections 1320 and 1325, a beginning of a return header 1215 of the first heat exchanger is attached to an end of a return header 1330 of the expansion unit.

An advantage of embodiments using constant diameter headers is that it facilitates purging the heat exchanger of air when filling it for the first time. The parallel flow arrangement discussed above has the potential at each diameter reduction to trap air. Because the size reductions are not present in the reverse flow embodiment discussed above, there are fewer spots where air can become trapped.

Parallel flow, constant diameter header—it is possible to construct a heat exchanger unit this way, however it would require 50% more header pipe to accomplish the same result as a reverse flow constant diameter header, therefore it would more expensive than in reverse flow constant diameter headers.

Reverse flow, varying diameter header—this configuration is less than optional because in order for the varying diameter to be of value, it is arranged in parallel flow configuration.

The heat exchanger according to the present invention is constructed by supporting a rigid structural member at an installation height at least sufficient that the exchange tubes clear a floor of the construction area. Attaching backbone brackets to the rigid structural member. Securing header tube support brackets to the rigid structural member and/or backbone bracket, attaching exchange tube support members to the backbone bracket. Wrapping exchange tube coils around the exchange tube supports. Securing supply and return header tubes to the header tube support brackets. Attaching exchange tube supply ends to fittings on the supply header tube. Attaching exchange tube return ends to fittings on the return header tube. Attaching end caps to secure exchange tube coils at ends of the heat exchanger.

And, attaching supply and return connection ends and fittings to the supply and return header tubes.

The heat exchanger is installed by placing the heat exchanger over a mounting position. In water, the heat exchanger is above or at least near a floating buoyancy because the coils and exchange tubes are not flooded. Fluid is then added to the heat exchanger coils and header tubes until it drops to or near an installation level. The heat exchanger is guided until it is at or near the installation level. The heat exchanger is then attached to a pedestal, cross piling support member or other foundation. Preferably, the heat exchanger is attached at the free areas 440.

The installation process is facilitated by the near buoyant qualities of the heat exchanger and the adjustable nature of the buoyancy (e.g., filling any of the tubes or coils with fluid). Buoyancy is also an advantage of the heat exchanger when installed because it also supports the heat exchanger, reducing an amount of weight that needs to be carried by the pier or other structure to which the heat exchanger is mounted. Buoyancy support is particularly advantageous on old or historic structures that would be weakened or do not have sufficient structural rigidity for installation of other heat exchanging devices.

The arrangement of horizontally placed coils of tubes provides additional advantages in clearing or cleaning out the heat exchanger as part of normal maintenance or repair operations. The present inventors have determined that a low pressure (low velocity) flush of approximately 12 gallons per minute of water through a 1" tube (e.g., donut shaped tubes) is sufficient to clear the coils and remove any air. Removal, or purging, of air is particularly important before initial start-ups of the heat exchanger.

Although the present invention has been described mainly as a heat exchanger to cooling a hot fluid, the present invention also includes the use of the structures and processes described herein to the reverse effect, that is to heat or warm up a cooled fluid circulated through the heat exchanger. Furthermore, in describing preferred embodiments of the present invention illustrated in the drawings, specific terminology is employed for the sake of clarity. However, the present invention is not intended to be limited to the specific terminology or underlying elements/structures being described by that terminology, and it is to be understood that each specific element and/or structure includes all technical equivalents which operate in a similar manner.

Obviously, numerous other modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A heat exchanger comprising:

a supply header pipe;

a return header pipe;

a set of exchange tube coils, each comprising a tube connected between the supply header pipe and the return header pipe and arranged in a coil; and a backbone support configured to support the exchange tubes in a horizontal manner;

wherein:

said backbone comprises, a rigid structural member, a set of backbone brackets attached to the rigid structural member, and at least two exchange tube supports attached to said set of backbone brackets;

wherein the exchange tube coils are wrapped around said backbone and the exchange tube supports.

2. The heat exchanger according to claim 1, wherein said backbone further comprises the exchange tube supports comprise a first exchange tube support fixed at a top end of said backbone brackets, a second exchange tube support fixed at a first side of said backbone brackets, and a third exchange tube support fixed at an opposite side of said backbone brackets.

3. The heat exchanger according to claim 1, wherein the exchange tube coils are attached to the exchange tube supports via nylon cable ties.

4. The heat exchanger according to claim 1, wherein the exchange tube coils are attached to the exchange tube supports via a clamping mechanism.

5. The heat exchanger according to claim 1, wherein said rigid structural member comprises a concrete pile.

6. The heat exchanger according to claim 1, wherein said backbone brackets comprise a frame having exchange tube support attachments for securing the exchange tube supports.

7. The heat exchanger according to claim 6, wherein exchange tube supports are constructed from semi-rigid pipes and the exchange tube support attachments comprise U-bolts placed around the semi-rigid pipes and bolted to a backbone bracket frame.

8. The heat exchanger according to claim 7, wherein said exchange tube supports comprise high density polyethelene.

9. The heat exchanger according to claim 1, wherein the heat exchanger is mounted between pilings of a pier.

10. The heat exchanger according to claim 1, wherein the heat exchanger is mounted under water.

11. The heat exchanger according to claim 9, wherein the heat exchanger is mounted such that the exchange tube coils are at an elevation below a mean low low tide for water below said pier.

12. The heat exchanger according to claim 9, further comprising at least one cross piling support member attached between support pilings of said pier and attached to said backbone.

13. The heat exchanger according to claim 12, further comprising "girts" placed between the cross piling support and the support pilings of said pier if a side of the support piling is not aligned with the cross piling support member.

14. The heat exchanger according to claim 11, wherein:

each cross piling support member comprises, a pair of channels attached to at least two support pilings of said pier, a cross member, supported by at least one of said channels on each of said at least two support pilings of said pier, and attached to said backbone.

15. The heat exchanger according to claim 12, further comprising "girts" placed between the channels and the support pilings of said pier if a side of the support piling is not aligned with the cross piling support member.

16. The heat exchanger according to claim 12, wherein:

each cross piling support member further comprises a backbone securing frame that clamps said backbone to the cross member.

17. The heat exchanger according to claim 1, further comprising:

a header frame attached to at least one of said backbone and the backbone bracket, said header frame having a header hanger attachment for securing the header pipes.

18. The heat exchanger according to claim 1, further comprising:

at least one an end cap, comprising, a support bar at an end of said heat exchanger attached to at least one of said exchange tube supports, said backbone, and a backbone bracket;

at least one retaining bar connected to said support bar above the exchange tube coils and running parallel to a longitudinal axis of the heat exchanger coils.

19. The heat exchanger according to claim 18, wherein said support bar comprises a T-shaped bar, and said retaining bars comprise attachments at each end of said T.

20. The heat exchanger according to claim 1, wherein said supply header and said return header are also two of the exchange tube supports.

21. The heat exchanger according to claim 1, wherein said heat exchanger is at a slightly positive buoyancy based on a combination of HDPE pipe used to construct the headers, exchange tube coils, and exchange tube supports, and the concrete pile used as said backbone.

22. The heat exchanger according to claim 1, wherein the heat exchanger is installed by lowering the heat exchanger into water and floating the heat exchanger into place.

23. A heat exchanger, comprising a supply header pipe;

a return header pipe;

a set of exchange tube coils, each comprising a tube connected between the supply header pipe and the return header pipe and arranged in a coil;

wherein:

said backbone comprises, a rigid structural member, a set of backbone brackets attached to the rigid structural member, and at least two exchange tube supports attached to said set of backbone brackets;

said exchange tube coils are wrapped around said backbone and the exchange tube supports; and said heat exchanger is mounted between pilings of a pier.

24. A heat exchanger comprising:

a supply header pipe;

a return header pipe;

a set of exchange tube coils, each comprising a tube connected between the supply header pipe and the return header pipe and arranged in a coil;

a supply riser connected to the supply header pipe;

a return riser connected to the return header pipe;

an intermediate support configured to hold at least one of the supply riser and return riser; and a riser support configured to receive the intermediate support via a moveable attachment.

25. The heat exchanger according to claim 24, wherein said riser support comprises a track having a series of position holes on the riser support to which the intermediate support is bolted.

26. The heat exchanger according to claim 24, wherein said riser support comprises a track configured to receive the intermediate support in a slideable manner.

27. A heat exchanger comprising:

a supply header pipe;

a return header pipe;

a set of exchange tube coils, each comprising a tube connected between the supply header pipe and the return header pipe and arranged in a coil; and a backbone support configured to support the exchange tubes in a horizontal manner;

wherein each header pipe is inclined at a connection end relative to a stopped end of the header pipe.

28. The heat exchanger according to claim 27, wherein each header pipe is capped at an end opposite to the connection end.

29. The heat exchanger according to claim 28, wherein the header pipes are high density polyethelene.

30. The heat exchanger according to claim 28, wherein the exchange tube coils are high density polyethelene.

31. A heat exchanger, comprising:

a supply riser connected to the supply header pipe;

a return riser connected to the return header pipe;

an intermediate support configured to hold at least one of the supply riser and return riser;

a riser support configured to receive the intermediate support via a moveable attachment; and a backbone support configured to support the exchange tubes in a horizontal manner.

32. The heat exchanger according to claim 31, wherein:

said backbone comprises a rigid structural member;

a set of backbone brackets attached to the rigid structural member; and at least one exchange tube support attached to said set of backbone brackets;

wherein the exchange tube coils are wrapped around said backbone and said at least one exchange tube support.

33. The heat exchanger according to claim 32, wherein said backbone comprises a rigid structural member, a plurality of brackets attached to the rigid structural support, and a set of at least one exchange tube supports secured to said brackets.

34. The heat exchanger according to claim 32, wherein the exchange tube coils are secured to at least one of the exchange tube supports.

35. The heat exchanger according to claim 34, wherein the exchange tube coils are secured via cable ties.

36. The heat exchanger according to claim 31, wherein the header pipes and exchange tube coils are configured in a cross arrangement where an input end of the exchange tube coils is oriented in a different direction than an output end of the exchange tube coils.

37. The heat exchanger according to claim 36, wherein said different direction is 180° from the input end orientation.

38. The heat exchanger according to claim 31, wherein the header pipes and exchange tube coils are configured in a parallel arrangement where an input end of the exchange tube coils are oriented in a same direction as compared to an output end of the exchange tube coils.

39. The heat exchanger according to claim 32, further comprising an end cap configured to limit lateral movement of the exchange tube coils at an end of the backbone.

40. The heat exchanger according to claim 39, wherein the end cap is attached to at least one of the exchange tube supports.

41. The heat exchanger according to claim 32, further comprising an end cap attached to at least one of said backbone and said exchange tube supports, and configured to hold the exchange tube coils at an end of said backbone so that they remain positioned around said backbone.

42. The heat exchange according to claim 31, wherein each header pipe has a connection end and a blind flange installed at an end opposite to the connection end.

43. The heat exchanger according to claim 42, further comprising an expansion unit heat exchanger bolted to the blind flanges.

44. The heat exchanger according to claim 31, wherein said connection ends are coupled to a source device that supplies fluid for heat exchanging purposes at the supply header connection end, and receives heat exchanged fluid from the return header connection end.

45. The heat exchanger according to claim 32, wherein at least one of the supply header and the return header are also used as at least one of the exchange tube supports.

46. The heat exchanger according to claim 31, wherein the supply header and return header have a parallel flow, varying diameter construction.

47. The heat exchanger according to claim 31, wherein the supply header and return header have a reverse flow, constant diameter construction.

48. The heat exchanger according to claim 31, wherein the supply header and return header have a parallel flow, constant diameter construction.

49. A method of constructing a heat exchanger comprising the steps of:

supporting a horizontal structural member at an installation height;

attaching backbone brackets to the rigid structural member;

securing header tube support brackets to at least one of the rigid structural member and backbone bracket;

attaching exchange tube support members to the backbone bracket;

wrapping exchange tubes around the exchange tube supports;

securing supply and return header tubes to the header tube support brackets;

attaching exchange tube supply ends to fittings on the supply header tube;

attaching exchange tube return ends to fittings on the return header tube;

attaching end caps to secure exchange tube coils at ends of the heat exchanger; and, attaching supply and return connection ends and fittings to the supply and return header tubes.

50. A method of installing a heat exchanger, comprising the steps of:

lowering the heat exchanger, which is at or near a floating buoyancy due to a combination of piping having buoyancy and a backbone constructed to support the heat exchanger in a horizontal manner, into water;

floating the heat exchanger into place over a mounting position in water at floating buoyancy;

adding fluid to at least one of the heat exchanger coils and header tubes;

guiding the heat exchanger until it is at or near the installation level; and attaching the heat exchanger to at least one of a pedestal, cross piling support member or other foundation.

51. A method of installing a heat exchanger, comprising the steps of:

lowering the heat exchanger which comprises a supply header pipe, a return header pipe, a set of exchange tube coils each comprising a tube connected between the supply header pipe and the return header pipe and arranged in a coil, and a backbone support configured to support the exchange tubes in a horizontal manner, wherein the backbone comprises a rigid structural member, a set of backbone brackets attached to the rigid structural member, at least two exchange tube supports attached to said set of backbone brackets, the exchange tube coils are wrapped around the backbone and the exchange tube supports, and the heat exchanger is at or near a floating buoyancy due to a combination of piping having buoyancy, into water;

floating the heat exchanger into place over a mounting position in water at floating buoyancy;

adding fluid to at least one of the heat exchanger coils and header tubes;

guiding the heat exchanger until it is at or near the installation level; and attaching the heat exchanger to at least one of a pedestal, cross piling support member or other foundation.

* * * * *